US007178689B2

(12) United States Patent
Wieser et al.

(10) Patent No.: US 7,178,689 B2
(45) Date of Patent: Feb. 20, 2007

(54) TABLE TOP FOLDED SHEET DISPENSER

(75) Inventors: Russell Wieser, Appleton, WI (US); Wolfgang Ott, Antioch, CA (US)

(73) Assignee: SCA Tissue North America LLC, Neenah, WI (US)

( * ) Notice: Subject to any disclaimer, the term of this patent is extended or adjusted under 35 U.S.C. 154(b) by 0 days.

(21) Appl. No.: 11/227,071

(22) Filed: Sep. 16, 2005

(65) Prior Publication Data

US 2006/0273102 A1 Dec. 7, 2006

Related U.S. Application Data

(63) Continuation of application No. PCT/US05/19475, filed on Jun. 3, 2005.

(51) Int. Cl.
*B65H 1/00* (2006.01)

(52) U.S. Cl. ..... 221/52; 221/45; 221/59

(58) Field of Classification Search ..... 221/59, 221/56, 58, 47, 48
See application file for complete search history.

(56) References Cited

U.S. PATENT DOCUMENTS

| | | | | |
|---|---|---|---|---|
| 2,435,104 | A * | 1/1948 | Solomon | 221/57 |
| 2,849,153 | A | 8/1958 | Tuttle | |
| 3,106,314 | A | 10/1963 | Spears | |
| 3,777,931 | A * | 12/1973 | Fleming | 221/57 |
| 4,311,252 | A * | 1/1982 | Hope et al. | 221/57 |
| 4,343,415 | A | 8/1982 | Radek | |
| 4,653,666 | A | 3/1987 | Mertens | |
| 4,706,844 | A * | 11/1987 | Omdoll et al. | 221/59 |
| 4,969,575 | A | 11/1990 | Kobayashi | |
| 5,100,020 | A * | 3/1992 | Petterson et al. | 221/45 |
| 5,813,569 | A * | 9/1998 | Cihanek | 221/150 R |
| 2003/0057221 | A1 | 3/2003 | Guillemette et al. | |
| 2004/0206769 | A1 | 10/2004 | Sanders et al. | |

FOREIGN PATENT DOCUMENTS

| | | |
|---|---|---|
| DE | 725 950 | 10/1942 |

* cited by examiner

*Primary Examiner*—Gene O. Crawford
*Assistant Examiner*—Timothy Waggoner
(74) *Attorney, Agent, or Firm*—Young & Thompson

(57) ABSTRACT

A dispenser includes a body having four side walls, a base and an opening in a top of the body. The base has end walls extending substantially parallel to the side walls so that the dispenser is substantially double walled. A lid is hingedly connected near the top of the body and covers the opening. The lid has a slot therein for sheet material to be dispensed therethrough. The dispenser also includes a platform that supports the sheet material. The platform is movable against forces of a compression element from a first position adjacent the lid to a second position spaced apart from the lid. The end walls have a plurality of ribs extending therefrom. The ribs engage a plurality of corresponding grooves in the platform so that the platform is slidably guided within the body along the ribs.

11 Claims, 5 Drawing Sheets

TABLE TOP FOLDED SHEET DISPENSER

CROSS REFERENCE TO RELATED APPLICATIONS

This application is a continuation of International Application No. PCT/US2005/019475, filed on Jun. 3, 2005, which designated the Unites States of America, the entire contents of which are hereby incorporated by reference.

BACKGROUND OF THE INVENTION

1. Field of the Invention

The invention relates to a dispenser, especially for dispensing sheet material.

2. Description of Related Art

Perhaps the most commonly used paper napkin dispensers in the food service industry are the ubiquitous side-dispensing containers in which a stack of non-interfolded papers napkins are pressed firmly against a relatively large dispensing opening via a spring-loaded plate.

Such napkin dispensers have a number of disadvantages, including that the napkins are pressed against the dispensing opening with such force that a user attempting to remove only a single napkin often merely tears small pieces off the exposed napkin, and, in frustration, then forcibly removes a plurality of napkins—more than he needs, and more than he initially wanted. The aggregate cost of such wasted consumables is a drain on the profit of the food service establishment The resistance to napkin removal in such dispensers also often overcomes the weight of the loaded dispenser, such that, unless the dispenser is somehow connected to the supporting surface, the dispenser will slide as the user attempts to withdraw napkin(s). This leads the customer to a two-handed operation, in which one hand is used to pull out the napkin(s) and the other hand is used to hold the dispenser in place. This is obviously undesirable from the hygienic standpoint and from the standpoint of the convenience of the user.

SUMMARY OF THE INVENTION

The invention aims to address and solve the above problems, or at least to provide structure that is somewhat less prone to one or more of the above problems.

An object of the invention is to simply and reliably dispense, preferably one-at-a-time, sheet material such as disposable interfolded napkins.

The dispenser has a body that is designed to sit on a support surface such as a table top or other level surface, such as a counter top or a ledge. The dispenser holds sheet material to be dispensed from a slot in the top of the body. The slot is facing upwards, toward a user and is opposite to the side that sits on the support surface. The sides of the dispenser may be transparent so that either a placard that is placed within the body or the quantity of sheet material in the dispenser can be viewed.

In a preferred embodiment, the sheet material rests on a platform that is substantially parallel to the support surface. A spring beneath the platform urges the sheet material towards the slot in the body, so as to be ready for dispensing.

The dispenser may be connected together using snap-fit connections so that the dispenser can be readily disassembled for cleaning.

DETAILED DESCRIPTION OF THE PREFERRED EMBODIMENTS

Figure 1:
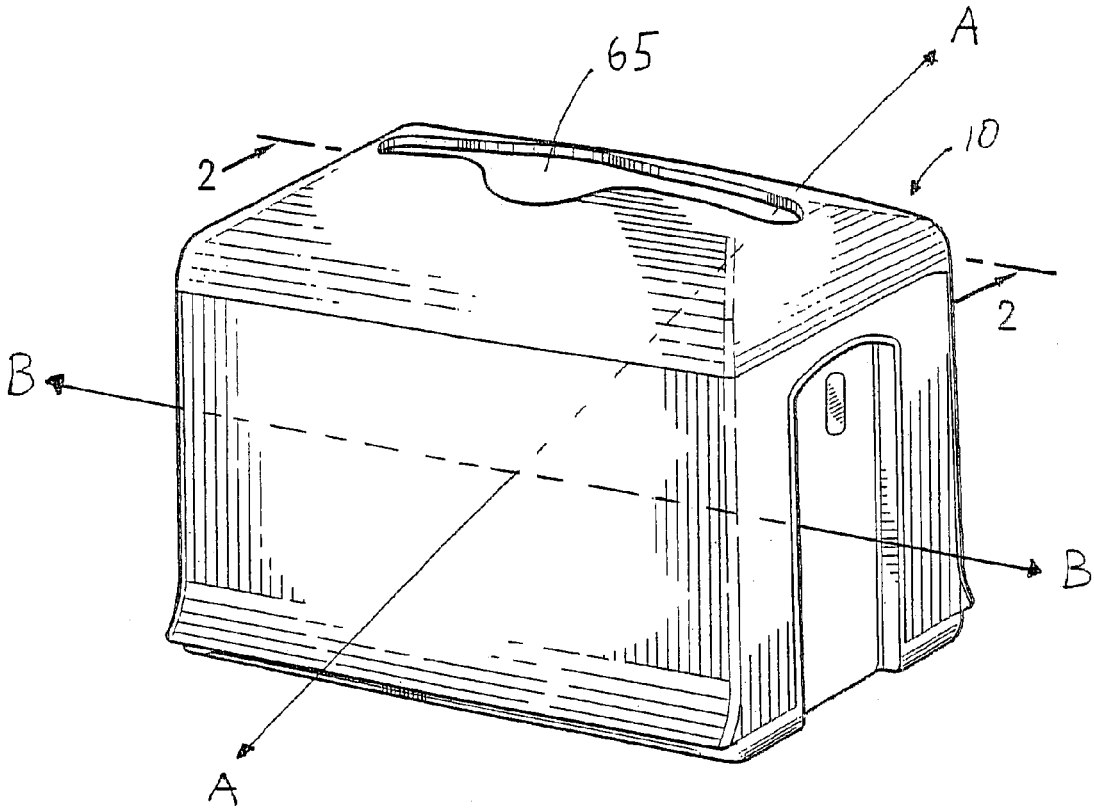
FIG. 1 is a perspective view of a dispenser according to an embodiment of the invention.
Figure 2:
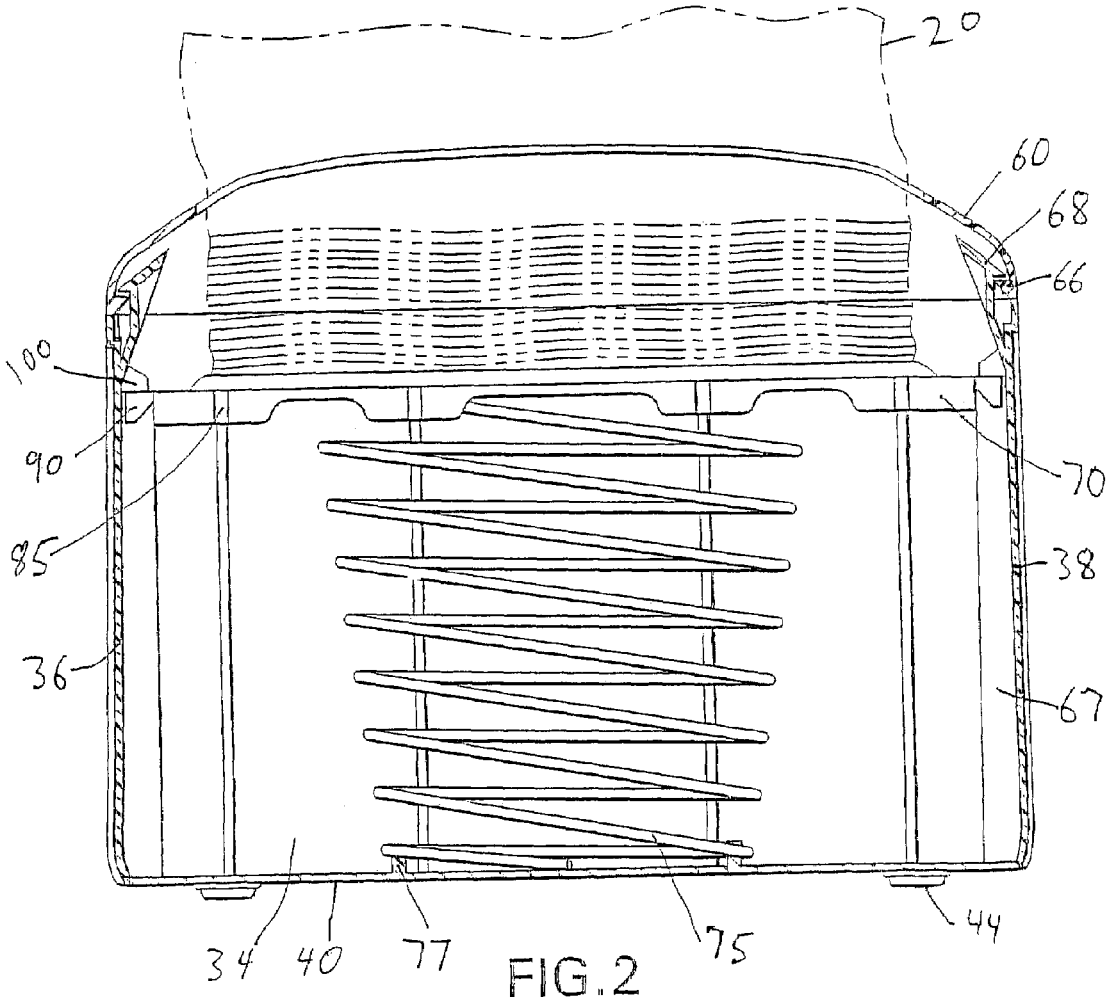
FIG. 2 is a cross-sectional view of the dispenser of FIG. 1.
Figure 3:
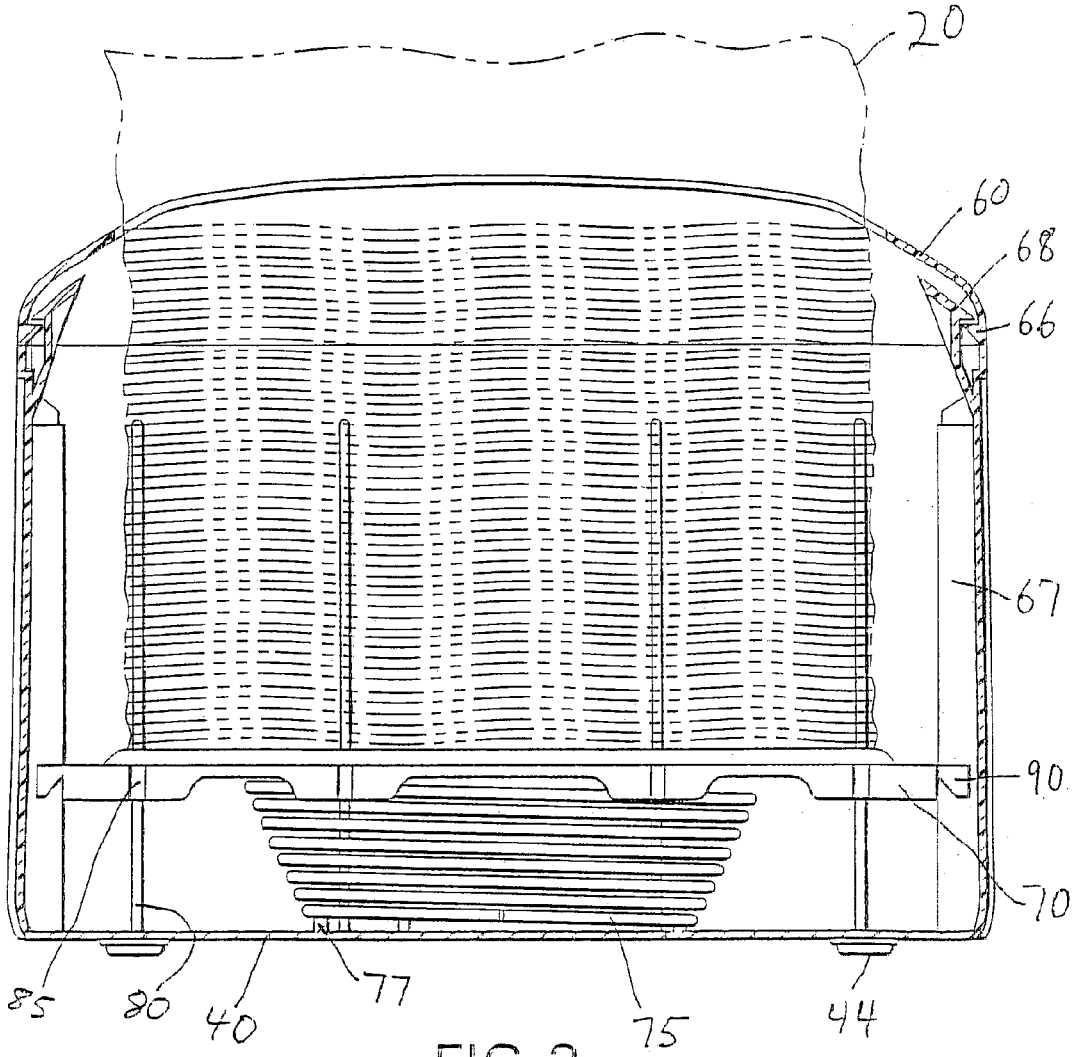
FIG. 3 is a view of the dispenser of FIG. 2 having additional sheet material loaded in the dispenser.

With respect to FIGS. 1–3, there is shown a dispenser 10 for dispensing sheet material 20. The sheet material 20 may be folded or unfolded. The sheet material may be stacked one on top of the other and/or may be overlapped, partially overlapped or interfolded so that when one sheet of sheet material 20 is pulled from the dispenser 10, another sheet of sheet material extends from a slot in the dispenser to be ready for dispensing, preferably in a one-at-a-time configuration.

The "sheet material" as used herein embraces not only paper products such as paper napkins, but also absorbent nonwoven materials not normally classed as papers or tissues. Such nonwoven materials include pure nonwovens and hybrid nonwoven/pulp sheets whose properties are similar to those of tissue paper, but which are based for example on nonwoven or airlaid materials containing low amounts of synthetic fibers, binders, wet strength agents and the like.

The sheet material presently preferred for use in the dispenser of the present invention is as described in commonly-owned co-pending U.S. patent application Ser. No. 10/660,694, filed Sep. 12, 2003, the entirety of which application is hereby expressly incorporated by reference herein.

In this regard, applicants contemplate their invention to reside not only in the dispenser itself, but also in the dispenser in combination with a stack of sheet material loaded therein.

Figure 4:
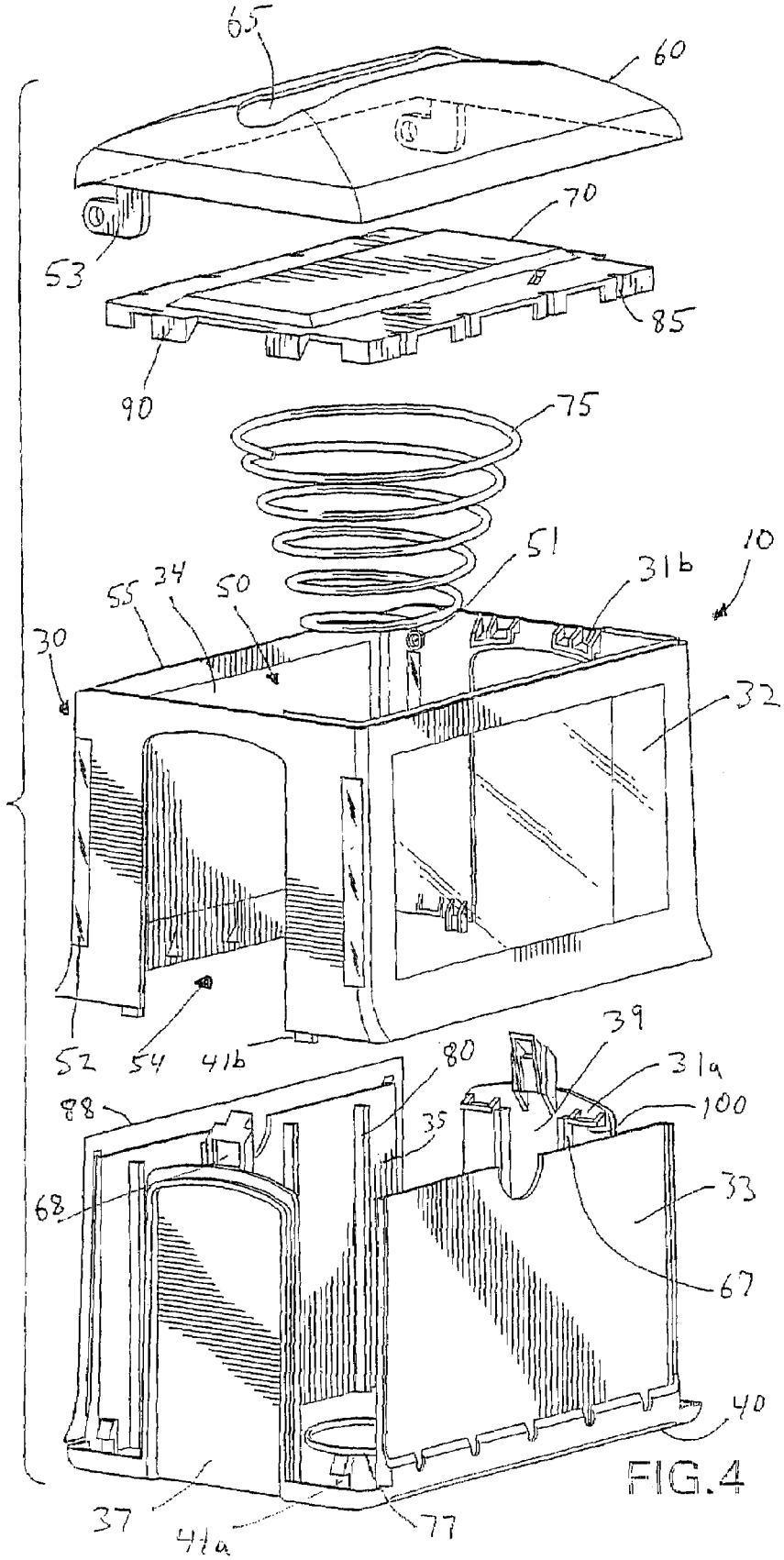
FIG. 4 is an exploded view of the dispenser of FIG. 1.
Figure 7:
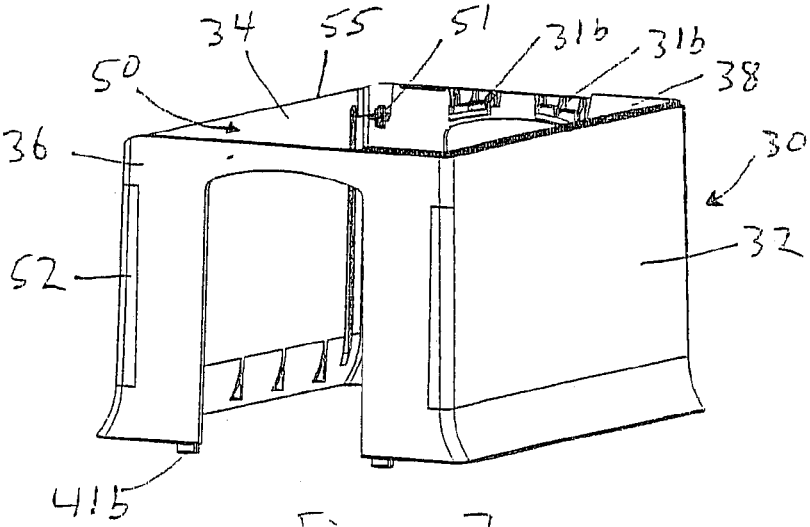
FIG. 7 is a perspective view of a body of the dispenser of FIG. 4.

As seen in FIGS. 4 and 7, the dispenser 10 includes a cover 30 having four side walls 32, 34, 36 and 38. The four side walls define an opening 50 in a top 55 of the cover 30. The cover 30 is preferably longer than it is wide so as to have a transverse axis A—A and a longitudinal axis B—B as seen in FIG. 1.

Figure 6:
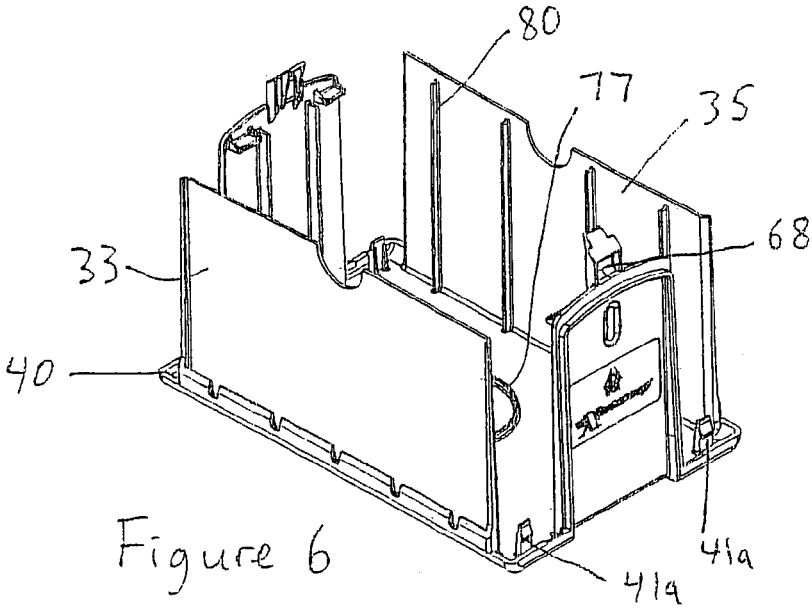
FIG. 6 is a perspective view of a bottom wall of the dispenser of FIG. 4.

As seen in FIGS. 4 and 6, the dispenser also includes a base 40. The base 40 rests on a support surface such as a table top. Rubberized feet 44 or the like may be attached to the underside of the bottom wall as shown in FIG. 2 to prevent or inhibit movement of the dispenser 10 with respect to the support surface, so that the dispenser is stable and does not rock, tip or lift off the table when in use. The feet 44 are preferably placed at or near the four corners of the base 40.

A lid 60 is hingedly connected by hinges 53 to an opposing two of the side walls 32, 34 at hinge socket 51. The hinge socket 51 is near the top 55 of the cover 30 (only a single hinge being visible in FIG. 4 and only a single hinge socket being visible in FIG. 7). In a closed position, the lid 60 covers the opening 50. See FIG. 1, for example. In an open position, the lid 60 may be opened sufficiently wide that a stack of sheet material may be added or removed from the dispenser. The lid 60 has a slot 65 therein that enables the sheet material 20 to be dispensed therethrough, preferably one-at-a-time, when the lid is in the closed position.

To promote one-at-a-time dispensing, the slot 65 as shown in FIG. 1 preferably comprises narrowed portion at its opposite ends, and a wider portion in its middle. The narrowed portions are preferably less than two inches in width, and are more preferably less than one inch in width. The slot 65 is preferably symmetrical with respect to vertical planes bisecting the slot both transversely and longitudinally, although symmetry with respect to only one such vertical plane is also possible.

Alternatively, the lid could slide and/or snap onto the cover, for bodily removal therefrom. It is contemplated in any of these embodiments to provide a set screw or other locking device to prevent the user from opening the lid.

In one embodiment, the lid 60 includes a catch 66. A notch element 68 adjacent to at least one of the side walls 32, 34, 36, 38 receives the catch 66. In the embodiment shown in the figures, there are two notch elements 68 adjacent to opposing walls 36, 38 and thus two catches 66. The catches 66 are releasable from the notch elements 68 when a respective one or more of the side walls is depressed. In the embodiment shown in FIG. 2, when side walls 36 and 38 are depressed, the lid releases from the body to enable sheet material to be added to or removed from a platform 70.

Figure 5:
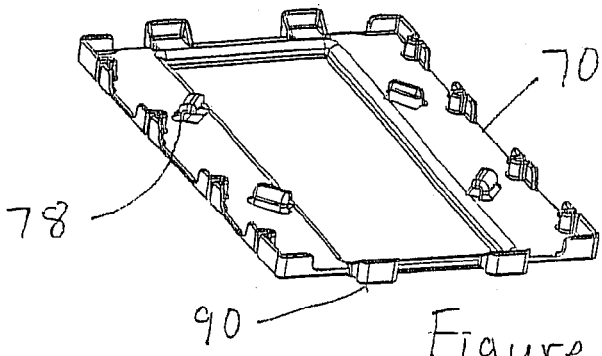
FIG. 5 is a bottom view of a platform of the dispenser of FIG. 4.

With respect to FIGS. 2, 4 and 5, platform 70 is substantially planar and slides within the cover 30. As seen in FIGS. 2 and 3, platform 70 supports a plurality of sheet material 20. The platform 70 is movable from a position adjacent the base 40 when the dispenser is full of sheet material 20 to a position adjacent the closed lid 60 when the dispenser is empty. Of course, when the dispenser has only a few sheets of sheet material 20 (see FIG. 2), the platform 70 will be closer to the lid 60 such that the more sheet material 20 is placed into the dispenser 10, the further the platform 70 will be placed from the lid 60 and the closer the platform 70 will be to the base 40.

To help maintain the platform substantially level and to guide the platform within the body, two opposing ones of the side walls 32, 34 have a plurality of ribs 80 extending at least partially from near the top 55 to near the base 40, only the ribs on side wall 34 being shown in FIG. 2. The platform has a plurality of corresponding grooves 85 so that the platform 70 is slidable within the cover 30 along the ribs 80. Four grooves 85 and corresponding ribs 80 are shown. However, the number of ribs and grooves can be greater or fewer than four. The ribs 80 and grooves 85 prevent the platform from rotating about transverse axis A—A.

As further seen in FIG. 2, for example, the platform 70 has a tongue 90 on each of opposing ends thereof. The tongues 90 engage a stop 100 to prevent movement of the platform 70 beyond the top 55 of the cover 30.

FIGS. 4, 6 and 7, show that the base 40 is detachably connected to the side walls 36, 38 using a first set of snap-fit connections 41*a*, 41*b*. The base includes end walls 33, 35, 37 and 39 extending substantially perpendicular to the base 40. End walls 33, 35 are substantially parallel to side walls 32, 34 so that the dispenser, at least with respect to side walls 32, 34 and end walls 33, 35, is double walled.

In a preferred embodiment, at least one of the side walls 32, 34 is transparent. It is also possible for both side walls to be transparent, and/or for any or all of the dispenser components to be transparent. The above-noted configuration allows advertising 88 to be displayed in the dispenser. Specifically, an advertising placard or the like can be place on or adhered to an outer surface of end walls 33, 35. When the transparent sidewalls 32, 34 are connected to the base 40 using the snap fit connections, the advertising placard can be seen through the transparent side walls 32, 34.

The end walls 33, 35 or the side walls 32, 24 may also be provide with spaced parallel rails (not shown), to permit printed advertising material to be removably slid within and held between the rails, without the need for an adhesive to hold the advertising material in place.

In this way, there are at least two available advertising areas; one behind side wall 32 and another behind side wall 34. This configuration allows the advertising to be visible to the viewer, yet the advertising placard is protected from direct contact with the user. The advertising placard can be readily exchanged for another placard by opening the lid and sliding the placard from the space between the end walls 33, 35 and the side walls 32, 34. If no advertising placard is between the end walls and side wall, then the user or napkin dispenser owner can visually reference the quantity of napkins in the dispenser to see if the dispenser needs refilling.

However, in case there is a placard between the end walls and the side walls, the level of napkins can still be determined because the corners 52 of the cover 30 may also be transparent.

As shown in FIGS. 4 and 7, the side walls 36, 38 are substantially inverted U-shaped having a space 54 between two legs thereof. An opposing two of the end walls 37, 39 extend from the base 40 to partially overlap the side walls 36, 38 and cover the space 54 (see FIG. 1). The side walls 36, 38 and the end walls 37, 39 snap-fit together using a second set of snap-fit connections 31*a*, 31*b* to form a substantially continuous wall as seen in FIG. 1.

The end walls 37, 39 include the stop 100 that prevents movement of the platform 70 beyond the top of the cover. However, the base does not necessarily need end walls 37, 39 such that the stop 100 could be on the side walls 36, 38. FIG. 4 also shows that the notch elements 68 are attached to the end walls 37, 39 and extend above a top of the side walls 36, 38 for engagement with the catches 66 of the lid 60.

In order to raise the platform 70 as sheet material is dispensed, the dispenser 10 includes a device to push against the weight of the sheet material. Such a device could be a spring 75 positioned between the base 40 and the platform 70 (see FIGS. 2 and 3). The spring urges the platform from a position nearer the base 40 (FIG. 3) to a position nearer the lid 60 (FIG. 2), as the napkins are dispensed.

The spring 75 is preferably conical so as to maximize the axial travel of the spring. As seen in FIGS. 2–4, the smaller end of the spring 75 fits around a raised circle 77 that is on an upper surface of the base 40. The raised circle 77 limits the spring from sliding too much with respect to the base 40. Preferably, the raised circle 77 is substantially the same height as a gauge of the spring material so that the spring can be fully compressed without the platform being prematurely arrested in its downward range by contacting the raised circle. Thus, FIG. 3 does not show the lowermost position of the platform 70. In the lowermost position, some or all of the coils of spring 75 will lie in a common plane, owing to the conical shape of the spring, such that the downwardly depending flanges of the platform 70 will contact the bottom surface of base 40. This arrangement allows more napkins to be accommodated for a given total dispenser height.

As seen in FIG. 5, the bottom of the platform has a plurality of substantially c-shaped holder members 78 that confine the wider end of the spring 75. Although FIG. 5 shows four holder members 78, one skilled in the art would appreciate that more or fewer holder members could be used. The c-shaped holder members 78 also prevent movement of the spring with respect to the platform.

As set forth above, the platform itself is stabilized against movement in a transverse direction by ribs 80 and grooves 85. In order to further stabilize the platform 70, the platform includes a pair of tongues 90 on each side thereof. The tongues not only engage the stops as outlined above, but also prevent skewing of the platform 70 about longitudinal axis B—B.

Specifically, end walls 37, 39 include a pair of ridges 67 extending substantially from the base 40 to the top. Inner surfaces of a respective one of the pair of tongues 90 slidingly engage an outer surface of a corresponding one of the pair of ridges 67 (see FIG. 2). Accordingly, the ribs 80, the grooves 85, the tongues 90 and ridges 67 act as a means for guiding the platform.

The dispenser 10 of this embodiment has five basic component groups, the base 40 with extending end walls, the cover 30 with four side walls, the spring 75, the platform 70 and the lid 60. These components snap together to allow the dispenser to be disassembled for easy cleaning as required. In this regard, the components made be fashioned of either metal or plastic, but in either case should have sufficient inherent resiliency to permit them to be flexed slightly for the snap-fit assembly. Accordingly, the dispenser of the invention is relatively easy to manufacture and assemble. In addition, the dispenser is readily placed on a substantially horizontal surface, such as a table, so that sheet material is easily dispensed from the top of the dispenser.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

The invention claimed is:

1. A dispenser for dispensing sheet material, comprising:

a body having four side walls, a base including plural feet for resting on a support surface, and an opening in a top of said body;

a lid connected to at least two of said side walls near said top of said body and covering said opening, said lid having a slot therein to enable sheet material to be dispensed therefrom, said plural feet being on an opposite side of said body from said slot; and a platform for supporting a plurality of sheet material from below, said platform being movable from a first lowermost position when said dispenser is filled with sheet material to a second uppermost position adjacent said lid when said dispenser is more nearly empty of sheet material, wherein said base is detachably connected to said side walls, said base further comprising end walls extending substantially perpendicular to said base and parallel to said side walls so that said dispenser is at least partially double walled.

2. The dispenser as claimed in claim 1, wherein an opposing first two of said side walls are substantially inverted U-shaped having a space between two legs thereof and an opposing first two of said end walls extend from said bottom wall to partially overlap said first two of said side walls and cover said space.

3. The dispenser as claimed in claim 2, wherein each of said opposing first two of said end walls comprise a stop that prevents movement of said platform beyond said top of said body.

4. The dispenser as claimed in claim 3, wherein an opposing second two of said end walls have a plurality of ribs extending at least partially from said top to said bottom wall, and wherein said platform has a plurality of corresponding grooves so that said platform is slidable within said body along said grooves.

5. The dispenser as claimed in claim 4, wherein said platform further comprises a pair of tongues on each side thereof, and wherein each of said first two of said end walls comprise a pair of ridges protruding therefrom that extend substantially from said bottom wall to said top, an inner surface of a respective one of said pair of tongues slidingly engaging an outer surface of a corresponding one of said pair of ridges, said tongues contacting a respective stop to prevent movement of said platform beyond said top of said body.

6. The dispenser as claimed in claim 1, wherein at least one of an opposing pair of said side walls of said body are transparent so that an exterior surface of said second two of said end walls is visible therethrough.

7. The dispenser as claimed in claim 6, wherein said second two of said end walls are transparent so that said sheet material is visible therethrough.

8. A dispenser for dispensing sheet material, comprising:

a body having four side walls, a base and an opening in a top of said body, said base comprising end walls extending substantially perpendicular to said base and parallel to said side walls so that said dispenser is partially double walled;

a lid connected near said top of said body and covering said opening, said lid having a slot therein to enable sheet material to be dispensed therethrough; and a platform that supports said sheet material, said platform being movable against forces of a compression element from a first position adjacent said lid to a second position spaced apart from said lid, wherein an opposing first two of said end walls have a plurality of ribs extending at least partially from said top to said bottom wall, and wherein said platform has a plurality of corresponding grooves so that said platform is slidable within said body along and guided by said ribs.

9. The dispenser as claimed in claim 8, wherein said platform further comprises a first pair and a second pair of tongues on opposing ends thereof, wherein an opposing second two of said end walls include a pair of ridges and a pair or stops protruding therefrom, said pair of ridges extending from adjacent said top to said bottom wall, said pair of stops extending adjacent said top, and wherein a respective one of said tongues contacts a corresponding one of said stops to prevent movement of said platform beyond said top of said body, an inner surface of a respective one of said tongues being slidably guided along a corresponding one of said ridges.

10. The dispenser as claimed in claim 8, wherein said compression element is a conical spring, a larger end of said spring contacting said platform.

11. The dispenser as claimed in claim 6, further comprising an advertising placard removably mounted on said exterior surface of said second two of said end walls and visible through said transparent side wall.

* * * * *